US007673762B2

(12) United States Patent
Humberto

(10) Patent No.: US 7,673,762 B2
(45) **Date of Patent: *Mar. 9, 2010**

(54) MODULAR SYSTEM OF CLOSET INSIDE PART OR DRESSING ROOM COMPLEMENT OF COMBINABLE AND ADJUSTABLE DESIGN EASILY ASSEMBLED AND PACKED BY THE USER

(76) Inventor: Orozco Gavaldon Humberto, Plaza Del Aguila : 12 Col. A., Ortiz CP. 09020, Mexico City (MX)

( * ) Notice: Subject to any disclaimer, the term of this patent is extended or adjusted under 35 U.S.C. 154(b) by 1732 days.

This patent is subject to a terminal disclaimer.

(21) Appl. No.: 10/812,434

(22) Filed: Mar. 30, 2004

(65) Prior Publication Data

US 2004/0256337 A1 Dec. 23, 2004

(51) Int. Cl.
*A47B 47/00* (2006.01)

(52) U.S. Cl. ..... 211/186

(58) Field of Classification Search ..... 211/186, 211/87.01, 182, 189, 123, 153, 90.01; 108/106, 108/107, 29, 193; 312/245, 263, 351, 203, 312/107, 108, 7.2

See application file for complete search history.

(56) References Cited

U.S. PATENT DOCUMENTS

| | | | | | |
|---|---|---|---|---|---|
| 3,478,891 | A * | 11/1969 | Kaeslin | 108/29 |
| 3,538,842 | A * | 11/1970 | Labbato | 108/29 |
| 3,692,378 | A * | 9/1972 | Sharp | 312/242 |
| 4,186,666 | A * | 2/1980 | Honickman | 108/29 |
| 4,206,955 | A * | 6/1980 | Cooper | 312/107 |
| 4,209,099 | A * | 6/1980 | Wickes | 211/182 |
| 4,324,076 | A * | 4/1982 | Honickman | 57/27 |
| D301,812 | S * | 6/1989 | Handler et al. | D6/414 |
| 4,928,833 | A * | 5/1990 | Huizenga | 211/187 |
| 4,995,323 | A * | 2/1991 | Kellems et al. | 108/157.13 |
| 5,016,764 | A * | 5/1991 | Bauer | 211/189 |
| 5,176,266 | A * | 1/1993 | Gillet | 211/90.04 |
| 5,191,986 | A * | 3/1993 | Huizenga | 211/189 |
| 5,582,306 | A * | 12/1996 | Balter et al. | 211/187 |
| 5,601,016 | A * | 2/1997 | Witte | 108/106 |
| 5,605,238 | A * | 2/1997 | Jacobs | 211/90.01 |
| 5,787,818 | A * | 8/1998 | Letersky | 108/180 |
| 5,810,179 | A * | 9/1998 | Kleiman | 211/88.01 |
| 5,865,517 | A * | 2/1999 | Wang | 312/237 |
| 5,909,936 | A * | 6/1999 | Daniels et al. | 312/334.1 |
| 6,079,803 | A * | 6/2000 | West et al. | 312/107 |
| 6,082,560 | A * | 7/2000 | Timm | 211/90.01 |
| 6,443,318 | B1 * | 9/2002 | Welsch | 211/90.02 |
| 6,681,941 | B1 * | 1/2004 | Johnson | 211/86.01 |
| 6,896,341 | B2 * | 5/2005 | Cattoire | 312/205 |
| 7,246,561 | B2 * | 7/2007 | Weatherly | 108/137 |
| 7,384,107 | B2 * | 6/2008 | Humberto | 312/245 |
| 2003/0155318 | A1 * | 8/2003 | Jacobs et al. | 211/189 |
| 2004/0256337 | A1 * | 12/2004 | Humberto | 211/87.01 |
| 2006/0169659 | A1 * | 8/2006 | Robinson et al. | 211/187 |

* cited by examiner

*Primary Examiner*—Sarah Purol
(74) *Attorney, Agent, or Firm*—Carmen Ekstrom

(57) ABSTRACT

Modular system for closet inside part or dressing room complement of combinable and adjustable design, mass manufactured with adjustable sizes, with combinable module systems to optimize the available space, standardized according to modern standards for popular or residential housing developments, characterized because it is easy to assemble, shows a strong resistance to impacts or overloads, with or without lateral edge reinforcements in the following combinable standard sizes 1.22, 1.83, 1.43, 2.44 and 3.05 m.

20 Claims, 10 Drawing Sheets

Figure 1C:
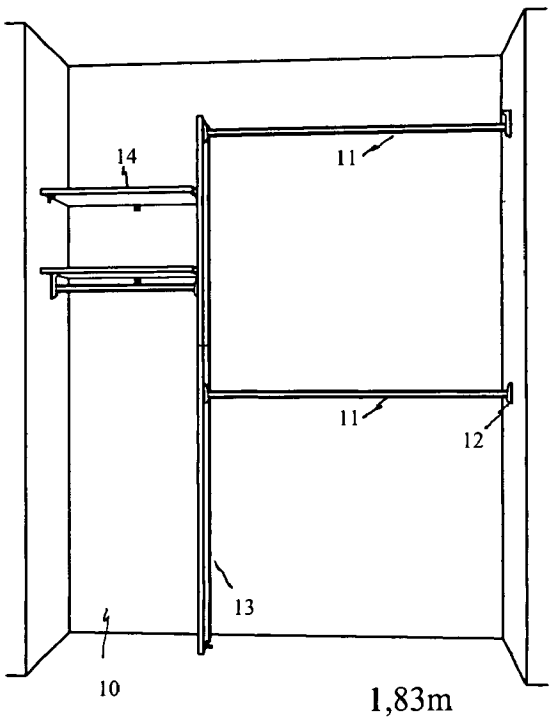

(UCO+2ROD) a (ECO+ROD+UCO+TAP) b 1,83m (ECO+ROD) c 1,22m (ECO) b 1,83m (ECO) a 1,43m (UCO) c 1,22m (UCO) b 1,83m (UCO) a 1,83m (EL4+ROD)

1,22m (EL4) b 1,83m (EL4) a (ECO+EL4) a 2,44m (ECO+UCO+TAP) b 2,44m (UCO+TAP+ROD)

(UCO+2ROD) a 3,05m 3,05m (ECO+ROD+UCO+TAP) b (ECO+2UCO+TAP+ROD)

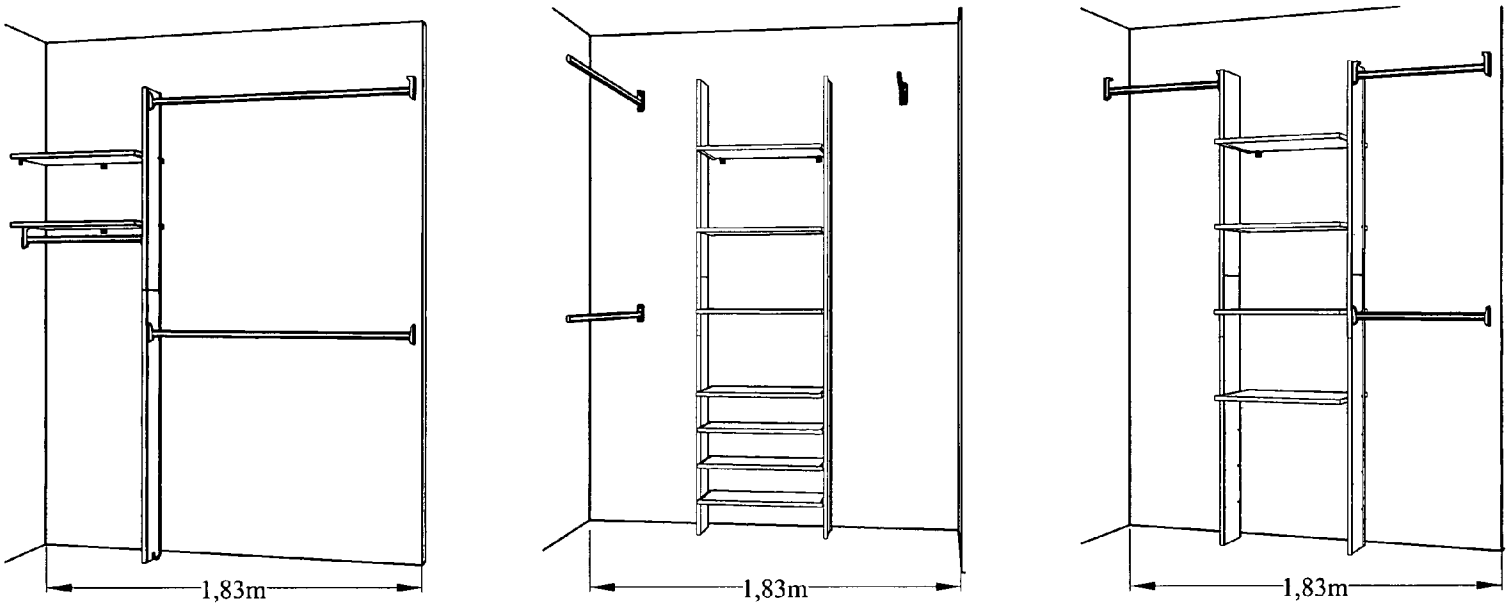
FIG. 9A
FIG. 9B
FIG. 9C
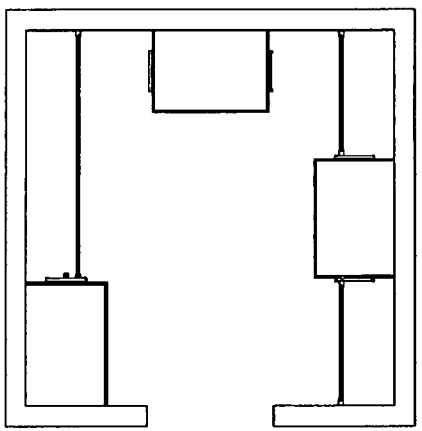
FIG. 9D (ECO+UCO+TAP)

MODULAR SYSTEM OF CLOSET INSIDE PART OR DRESSING ROOM COMPLEMENT OF COMBINABLE AND ADJUSTABLE DESIGN EASILY ASSEMBLED AND PACKED BY THE USER

BACKGROUND OF THE INVENTION

1. Field of the Invention

Modular system of closet inside part or dressing room complement of combinable design mass manufactured, of adjustable and standardized sizes according to the needs of modern popular or residential buildings, characterized because it is easy to assemble, highly resistant to impacts or items overload, and makes optimum use of wardrobe and other items spaces, with or without lateral edge reinforcement.

2. Description of the Previous Art

Several closet construction designs are known, such as the assembling of pieces or modules generally of solid wood, fine wood or pine wood. For example, British Patent 640,518, describes a dismountable closet based on a module with lateral and back walls formed as one single unit. Japanese Patent 5141080 describes the building structure of a closet based on a smaller member of parts through the use of grooved posts for the assembly of the lateral walls.

U.S. Pat. No. 5,718,490 describes a portable dismountable closet for travels, characterized because it has a textile cover on a supporting tubular structure for assembly purposes.

U.S. Pat. No. 4,209,099 describes a support module for closet to increase the usable space in the closet, based on bars placed in horizontal or vertical positions and assembled on collapsible cylindrical pipes through connecting elements with intersection joints.

Japanese Patent 5098791 describes the formation of a closet through the assembly of wooden frame shaped panels with heat insulation structure with "U" shaped sections and fixed onto posts, forming units.

U.S. Pat. No. 6,079,803 describes a system of closet organization and a method for its installation, characterized because it features the assembly of a console unit, the unit having tubular plastic posts to include additional racks.

U.S. Pat. No. 6,113,208 describes a self-assembly closet, that uses clip elements to fasten the shelves onto the lateral parts of the closet through a tongued and grooved assembly.

The above-mentioned inventions are generally characterized because they propose adjustable closets that can be assembled and dismounted. The invention relates to pieces of furniture such as closets, book shelves, etc. made of agglomerated-wood based materials that, through various manufacturing techniques, are made as resistant and durable as the pieces of furniture made of solid material. Moreover, said pieces of furniture can be assembled, dismounted and adjusted to the space available according to popular or residential building standards.

The instant invention is an embodiment of the manufacturing kit for closet inside part such as described in our Mexican Patent Application PA/a/2003/004388

DESCRIPTION OF THE INVENTION

Figure 1B:
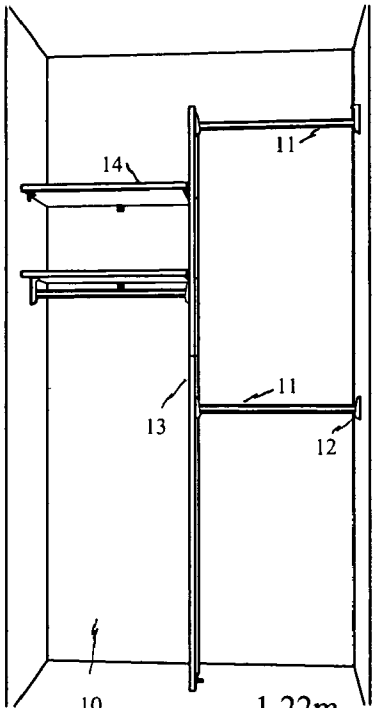
Figure 1A:
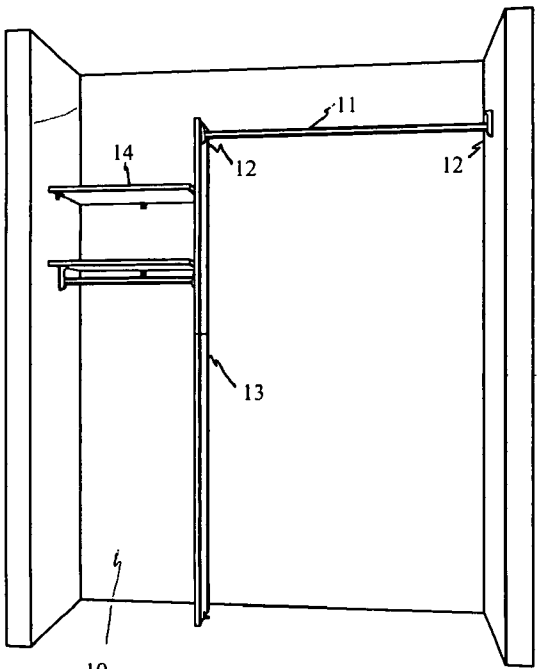

Hereinafter the invention will be described according to FIGS. 1 to 10 wherein:

FIG. 1 corresponds to a perspective view of a module (ECO) assembled in two different versions: a FIG. 1A, b FIG. 1B and first combination c FIG. 1C (ECO+ROD) of the closet inside part.

Figure 2C:
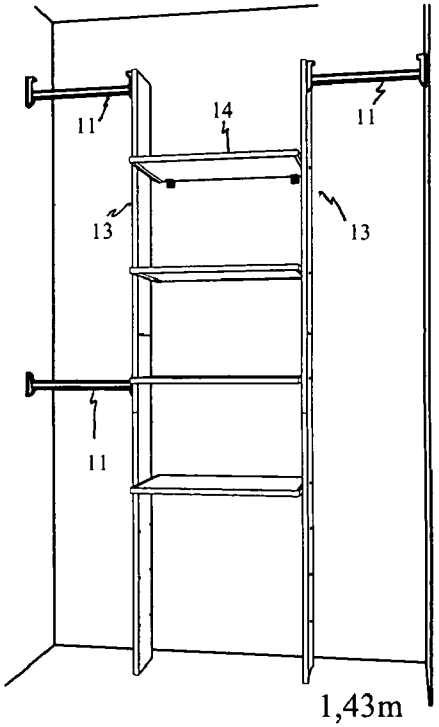
Figure 2B:
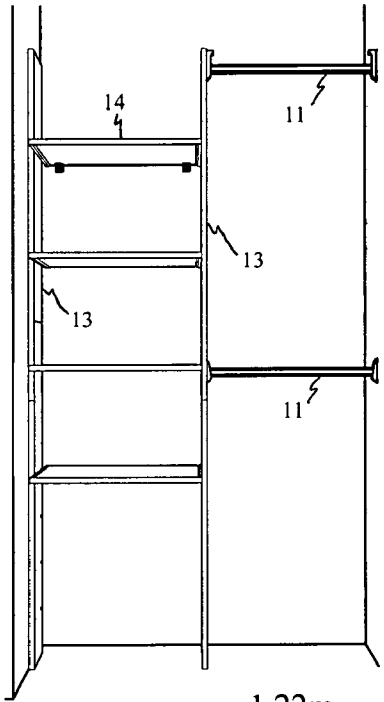
Figure 2A:
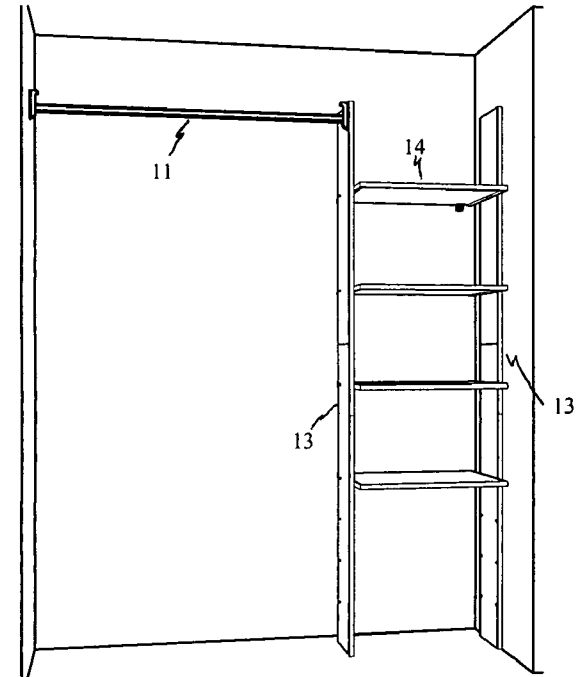

FIG. 2 corresponds to a perspective view of a module (UCO) assembled in three different versions: a FIG. 2A, b FIG. 2B and c FIG. 2C of the closet inside part.

Figure 3C:
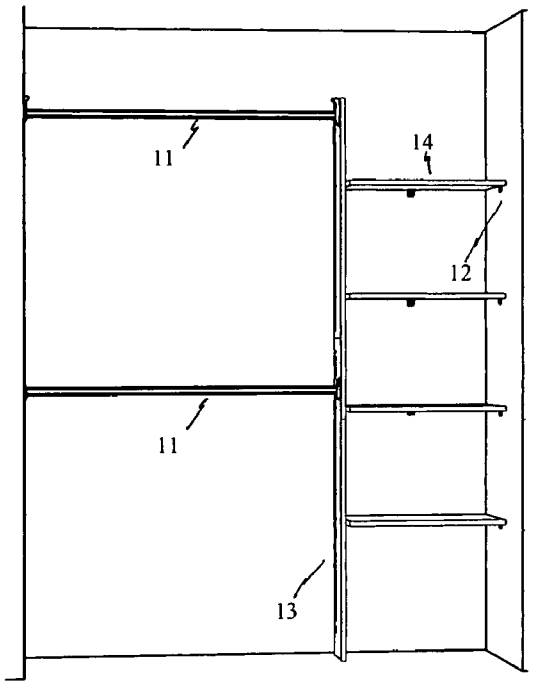
Figure 3B:
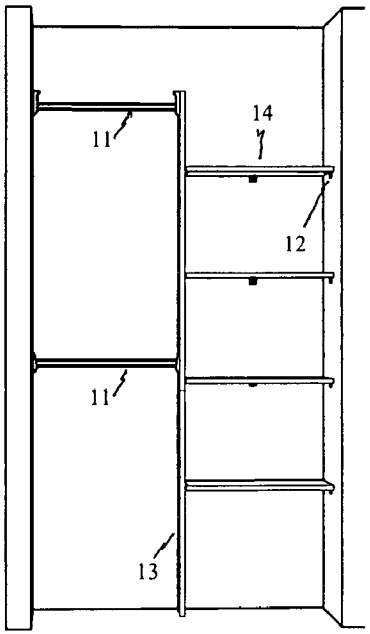
Figure 3A:
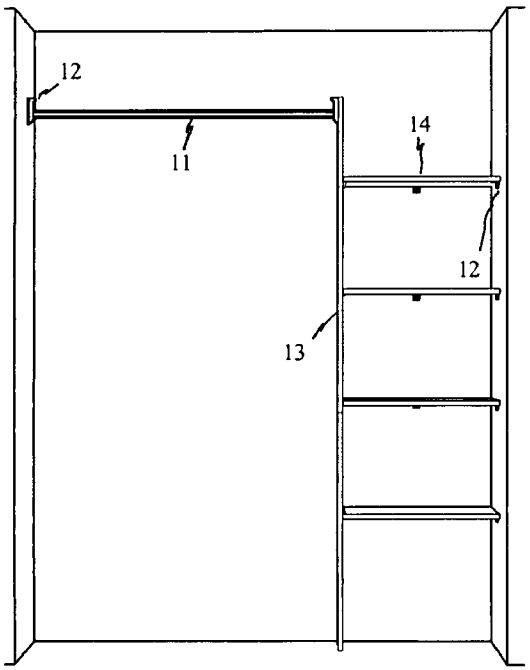

FIG. 3 corresponds to a perspective view of a module (EL4) assembled in two versions: a FIG. 3A, b FIG. 3B and a combination c FIG. 3C EL4+ROD of the closet inside part.

Figure 4A:
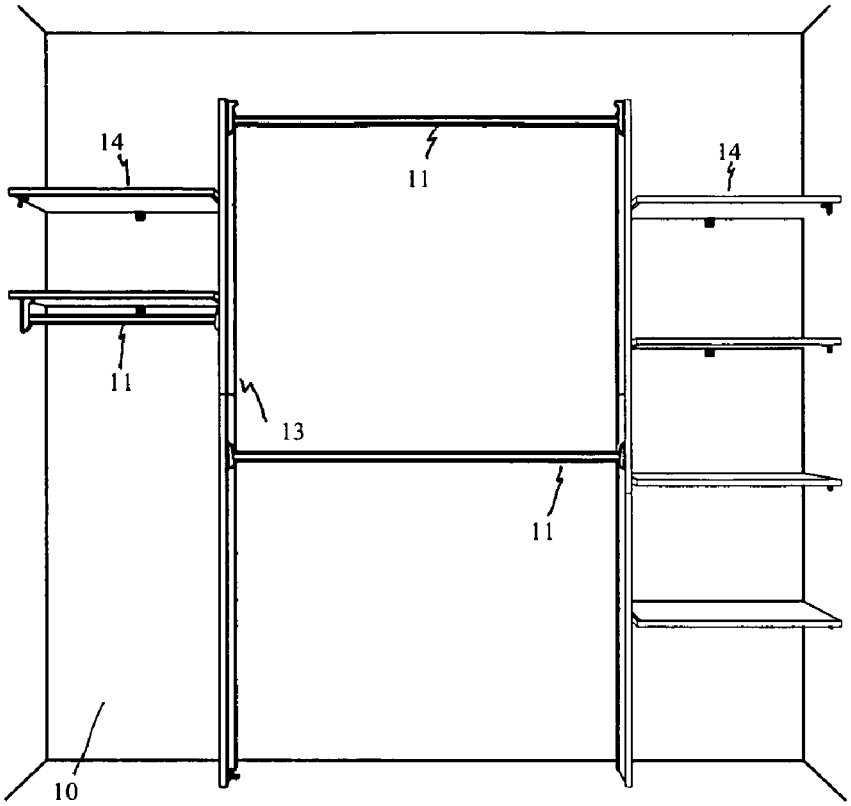
Figure 4B:
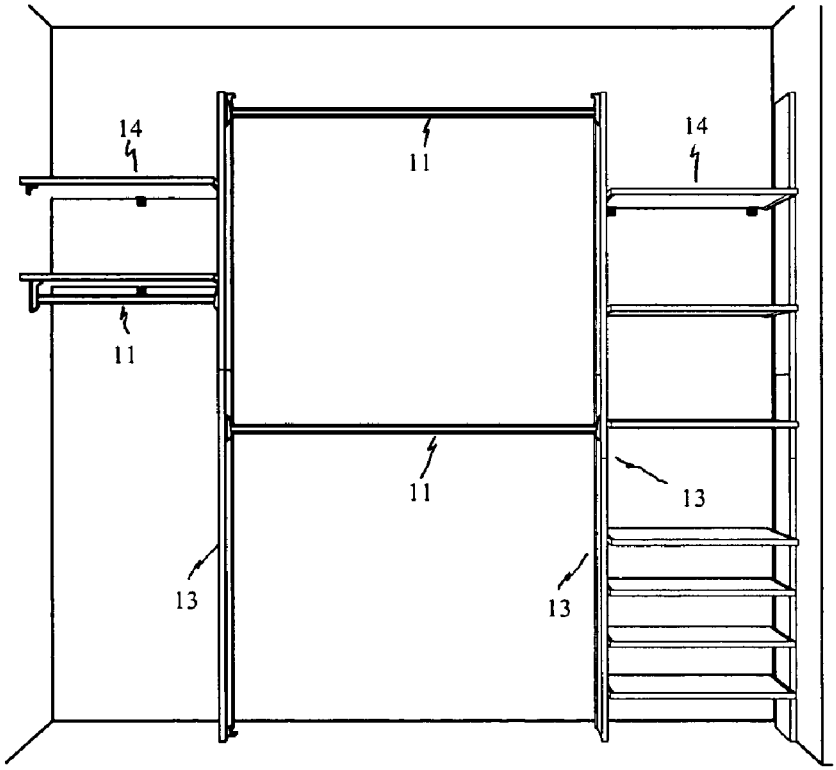

FIG. 4 corresponds to a perspective view of a module (ECO) assembled in two combinations: FIG. 4A (ECO+EL4) a, and FIG. 4B (ECO+UCO+TAP) b of the closet inside part.

Figure 5:
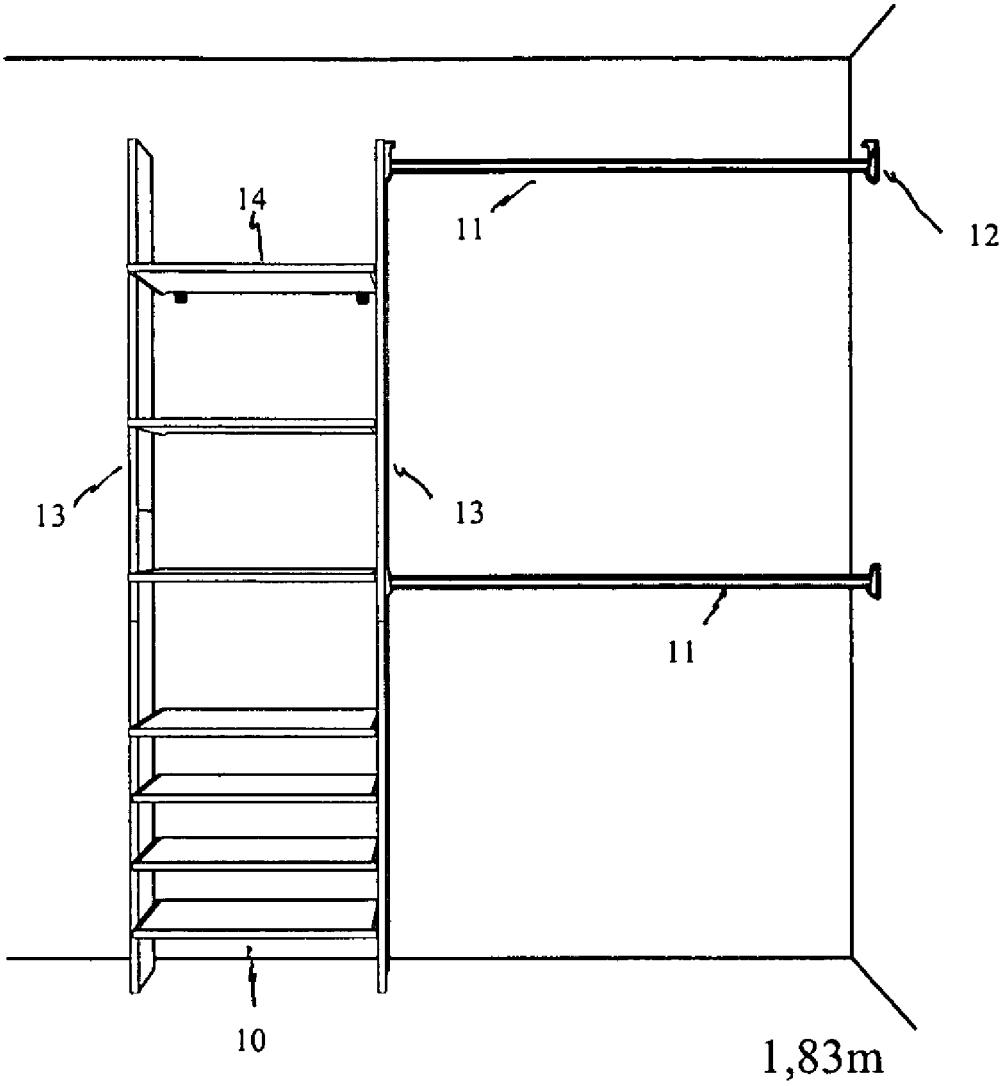

FIG. 5 corresponds to a perspective view of an assembly combination (UCO+TAP+ROD) of the closet inside part.

Figure 6A:
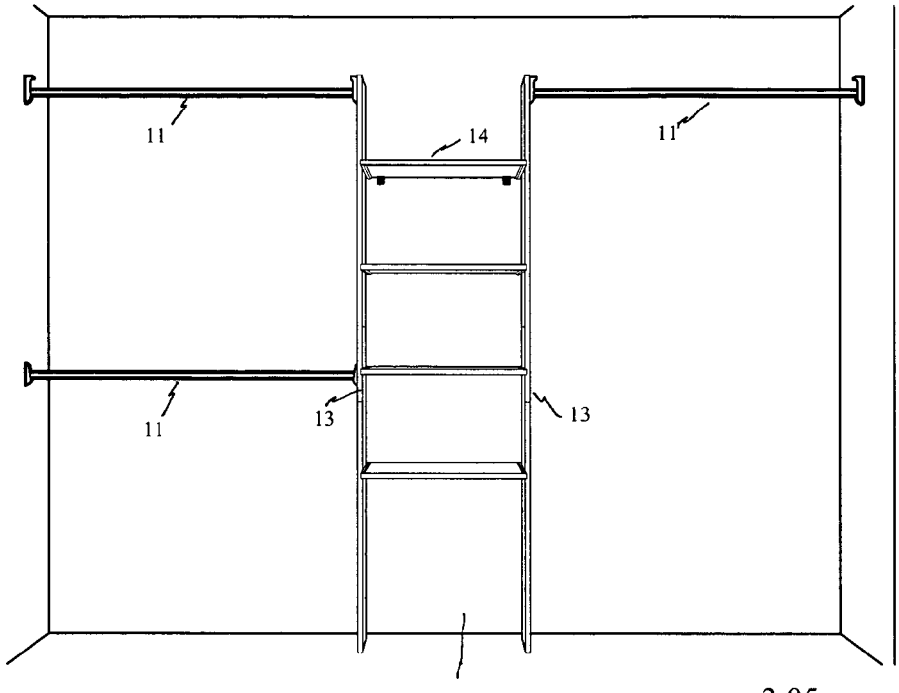
Figure 6B:
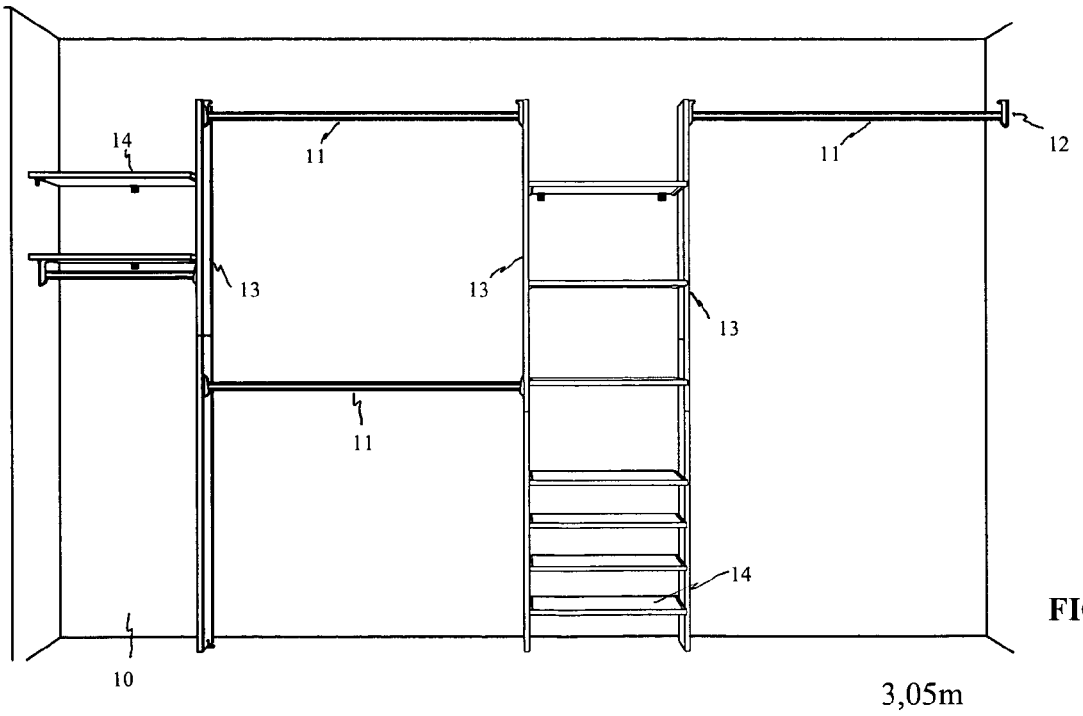

FIG. 6 corresponds to a perspective view of the assembly of two combinations FIG. 6A (UCO+2ROD) a, and FIG. 6B (ECO+ROD+UCO+TAP) b of the closet inside part.

Figure 7A:
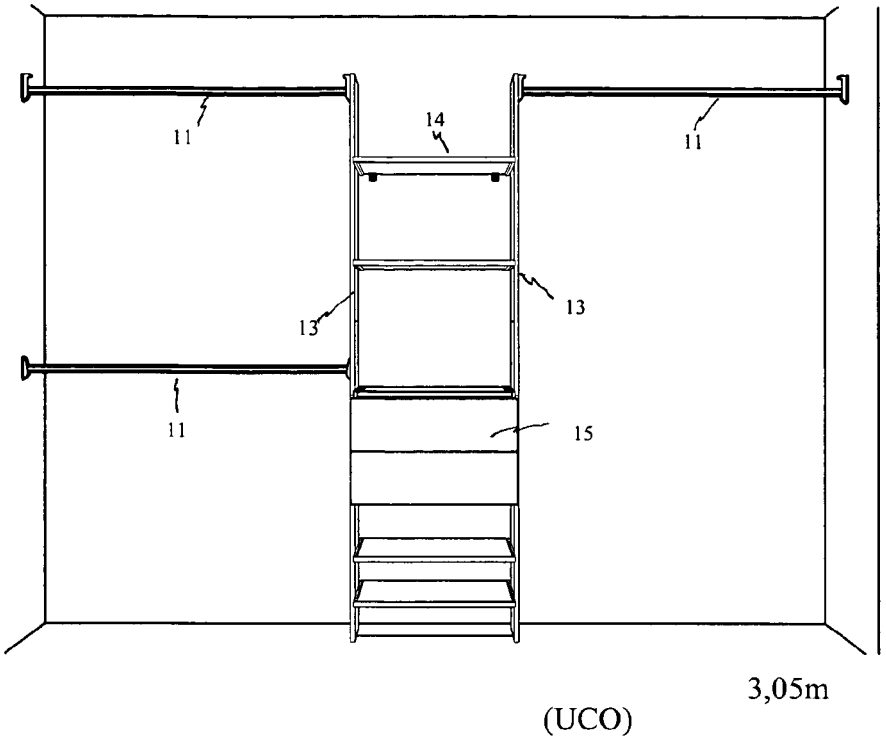
Figure 7B:
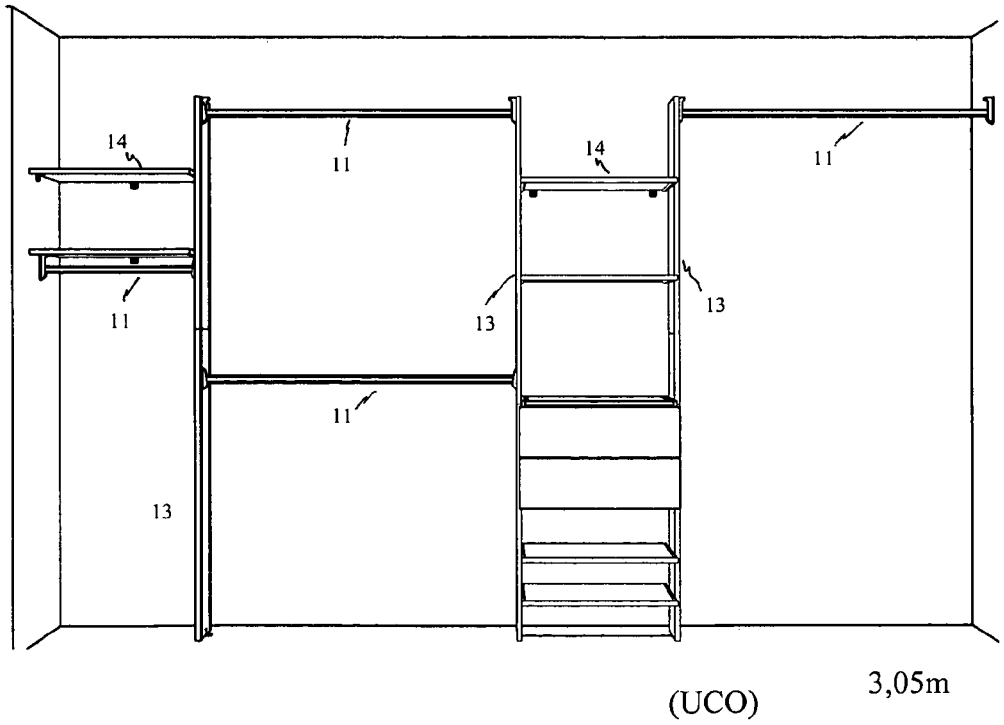

FIGS. 7A-7B corresponds to a perspective view of FIG. 6, including chest of drawers.

Figure 8B:
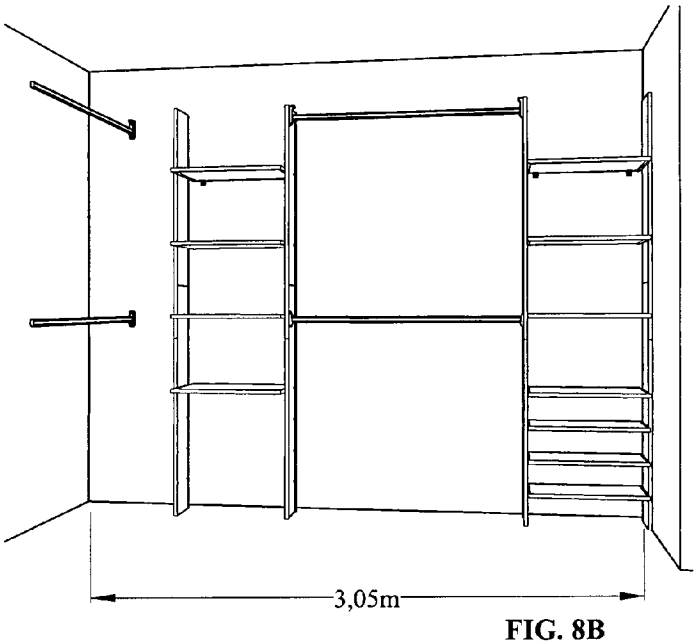
Figure 8C:
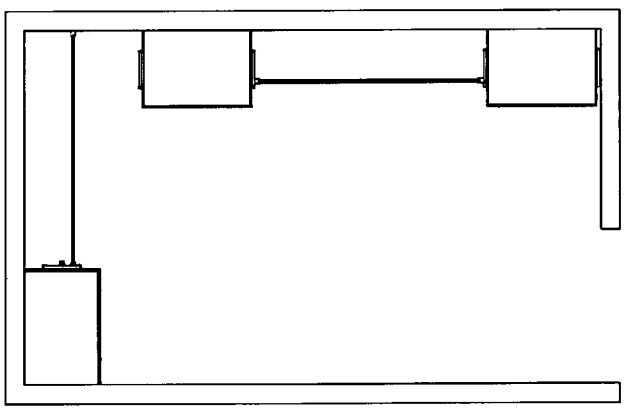
Figure 8A:
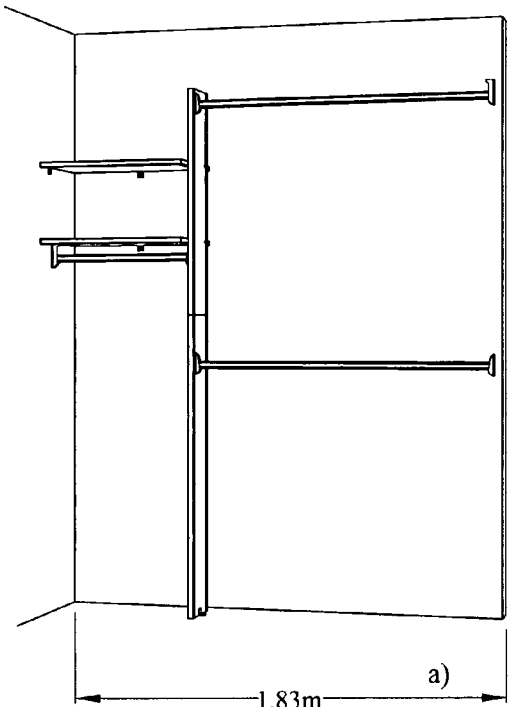

FIGS. 8A, 8B and 8C corresponds to a perspective view of a dressing room of 1.83 m/3.05 m with modules (ECO+2UCO+TAP+ROD) arranged in "L" shape.

FIGS. 9A-9D corresponds to a perspective view of a square dressing room of 1.83 m/1.83 m with front side views a, b, c and top view d, with modules (ECO+2UCO+TAP+ROD).

Figure 10B:
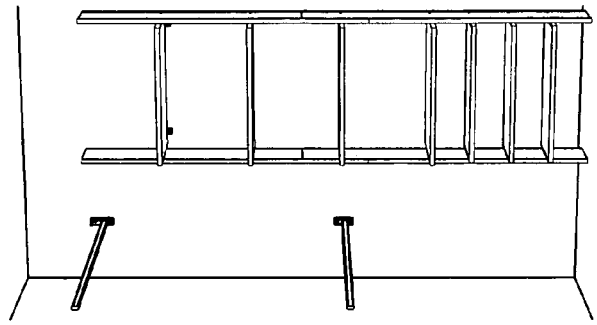
Figure 10A:
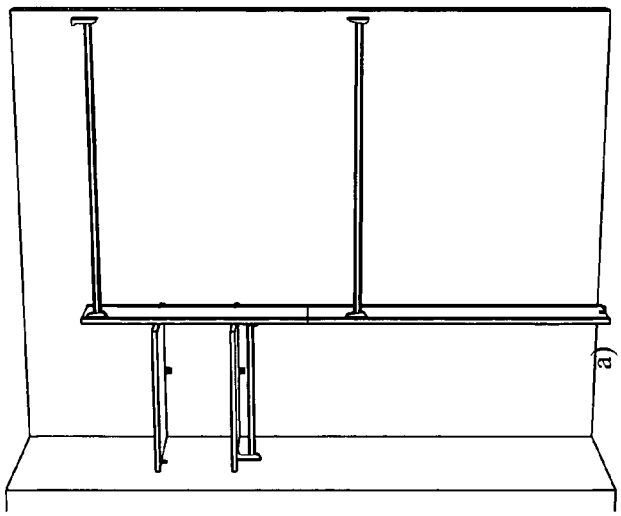
Figure 10C:
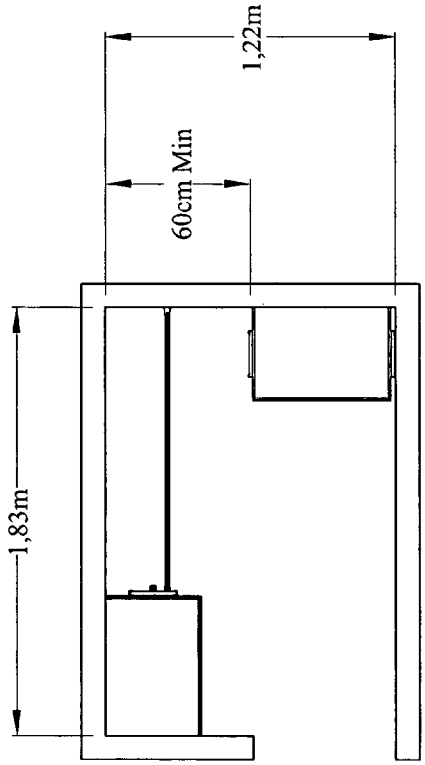

FIGS. 10A, 10B and 10C corresponds to a perspective view of a rectangular dressing room, 1.83 m/1.22 m with front side views a, b, and top view c with modules (EC+UCO+TAP).

GENERAL CHARACTERISTICS OF THE INSIDE PARTS OF THE CLOSETS MODULES UCO, ECO and EL4

Every package contains all the elements necessary to place a full modular system of the closet inside part within a previously available enclosure, the width of which will be within the width parameters mentioned as most important information on the package. Shelves, sections of vertical screens, hanging pipes and all the supports and assembly elements as well as wall fastening elements are included. To adjust the product to the size of the existing enclosure, the user only needs to cut the hanging pipes.

The vertical screens measure, in depth, only half the depth of the deepest shelves. Besides, the vertical screens are away from the back wall and in this way it is possible to keep the clothes placed on the shelves through the sides and at the same time what is placed on the shelves can be seen till the contact with the back wall, making it easier to clean. Clothes are ventilated in the deepest part, preventing stuffing which favors insect multiplication, fungus growth or moisture accumulation.

In this design, the vertical screens of the closets are separated from the back wall and because of this it is possible to place the closet without taking into account whether there is or not a skirting board in the area of the installation. If the screens were in contact with the back wall, it would be necessary to cut them or to cut the skirting board if there were one.

There are rooms, with or without skirting board, that have spiked wooden strips below the carpet for carpet placement. The separation of the screens with regard to the back wall permits to place the screen base on the floor. If the vertical screens were placed in contact with the back wall, only the back part of said screens would be on the spiked wooden strips used to place the carpet while the rest of the screen base would not be supported. The placement of the vertical screens away from the back wall makes it easier to adequately spread the weight of the closet and the load of the items placed in the closet and the load received by the hanging pipes that support hanging clothes avoiding in this way a possible maladjustment or deformation of the structure of the closet inside part.

For the user it is important to carry a relatively light package. Because it has vertical screens that are only half as deep as a deepest shelves, the weight corresponding to the screens is divided by half.

Because they measure half the depth of the deepest shelves, two pieces of vertical screen fit in only one layer of materials within the box instead of two layers of materials and thus the package is more compact.

It is possible to place each one of the closet inside parts individually within an existing enclosure or combine them, in pairs or the three of them together, depending on the width of the enclosure in which the user wishes to place the closet and his preferences.

The three models of closet inside parts have the option of cutting the segment of the hanging pipe included in the package in two segments half the original length and to place both segments on one side of the enclosure. In this way, with said three models, various solutions are offered to take advantage in different ways of the space with different closet inside parts that are adequate for the width of the smallest common enclosures in the market, such as in the case of social housing. As can be observed hereinafter, it is possible to add to the UCO model the set of shelves model TAP that can be used as shoe rack, and using the UCO model, it is possible to create a closet enclosure without a wall on one side.

The three closet inside parts are adequate to have as accessory a hanging pipe segment model ROD, which, because it is equal to the hanging pipe segment included in each one of the three packages, increases the clothes hanging capacity. The three inside parts of closets and their combinations, once placed, permit the placement of a shelf from to wall to wall that is not part of the system. Said shelves can also be placed only above the hanging pipes and supported on the vertical screens. In a similar way, instead of said shelves, on the vertical screens of the three closet inside parts, individually or in combination, it is possible to place a closet roof, which is an unbroken shelf from wall to wall and deep enough to place closet doors that are at least flush with the same and leave enough depth in the closet inside part for the hanging clothes. This type of roofs are common in the cases of heights much higher than 2.40 meters from floor to ceiling, a case which is most common in the case of the upper floor of a gable roof house. In these cases, the client can keep more items than the ones fitting in the closet inside part, placing them on the roof of the closet and taking advantage of the free space on said roof, although said items are visible.

FIG. 1.—According to the drawings of the module (ECO) a FIGS. 1A and b FIG. 1B, said module comprises an upper shelf tower 10, one or several hanging pipe elements 11 and support elements 12 to fasten the banging pipes; it also includes one or two vertical screens 13 placed on one side or on both sides of tower 10 and comprising an assembly of two panel sections A and B, with or without lateral edge reinforcements through plastic structured profiles or only by screwing with specially designed screws forming only one piece. The two-section screen 13 has the advantage of being available in only one package, that has moreover for the user the characteristic of having the same shelf thickness 14 of the tower 10 and thus the weight of the modular system is lower, packed in a compact volume and easy to carry by the user. The module (ECO) is available in two embodiments a and b, being the (a) module available in sizes 1.83 m width by 1.22 m. In another of its embodiments (ECO+ROD), with two short hanging elements 11 and a long one, it can be available in 1.22 m or 1.83 m width, the height being conventional according to the floor-ceiling distance which is usually 2.40 m.

The vertical screens are half as wide as the depth of the shelves 11 and said shelves are fastened at mid depth in such a way that they are spaced with regard to the enclosure, i.e. they are not fastened touching the wall of the enclosure.

FIG. 2.—The module (UCO) has three embodiments a FIG. 2A, b FIG. 2B and c FIG. 2C i.e. with different widths (UCO)a: 1.83 m; (UCO)b: 1.22 m and (UCO)c: 1.43 m. All of them have a tower 10 with shelves 14 and hanging elements 11 as well as double screen 13, which permits to combine the tower with different arrangements a, b and c according to the needs of the user.

FIG. 3.—The module (EL4) FIG. 3A, FIG. 3B and FIG. 3C also has three embodiments (EL4) a: 1.83 m wide, and long hanging element 11, four shelves 14 equidistantly placed and only one screen; (EL4)b: 1.22 m, two hanging elements 11 and four shelves 14 and fastening elements 12, and only one screen 13 of tower 10; and a combination of (EL4+ROD) which is 1.83 meters wide with two banging elements 11.

FIG. 4.—The module (ECO+EL4) a FIG. 4A forms a new design with two laterally arranged shelf tower 10 and in between with two hanging elements 11, being the left side tower formed by two upper shelves 14 and a screen, while the right lateral side of the tower consists of four shelves equidistantly placed fastened by a second screen 13 and fastening elements 11 onto walls of the enclosures and screens.

The second combination (ECO+UCO+TAP) b FIG. 4B comprises a new module with two shelves towers 10 similarly arranged as the previous module having the characteristic of including in the UCO module a larger number of lower shelves (TAP).

Both the (ECO+EL4)a module and the (ECO+UCO+TAP)b module have a width of 2.44 m.

FIG. 5.—The module presents the combination of three modules (UCO+TAP+ROD) integrated by a tower with upper and lower shelves 14 based on two screens, and two hanging elements and fastening elements 12 onto the walls of the enclosure and screen width of 1.83 m.

FIG. 6.—The module presents two combinations, one being (UCO+2 ROD) a, FIG. 6A based on a shelf tower 10 placed at the center with four shelves 14 equidistantly placed, with two lateral screens 13, two hanging lateral elements 11, being the one of the left with the double hanging 11 and the one of the right with only hanging elements 11, and 3.05 m wide. The combination module (ECO+ROD+UCO+TAP) b FIG. 6B consists of two shelves towers 10, the left one with two upper shelves and the right one with three shelves 14 equidistantly distributed in the upper intermediate part, and in the lower part it includes three shelves 14 for shoes (TAP), the towers are integrated by three screens 13. Between said towers 10, a hanging module larger than the towers (c) is incorporated, having two hanging elements 11, while the right lateral hanging module D is smaller but also has two hanging elements 11 and the left lateral module E has one long clothes hanging element 11, and fastening elements for the walls and screens, being the module 3.05 m wide.

FIG. 7.—This module is a combination of the module of FIG. 6 with chests of drawers 15 which can be included in any of the (UCO) type modules. FIG. 7A and FIG. 7B.

FIG. 8.—This module includes a combination a FIG. 8A and b FIG. 8B for the dressing room based on (ECO+2 UCO+TAP+ROD) modules arranged in an "L" shape FIG. 8C in a space 1.83 m deep and 3.05 m. long. Each one of the modules is mass manufactured and available in one single modular system packed in such a way that the user can choose the sizes according to his or her needs.

FIG. 9.—FIGS. 9A, 9B and 9C This module is applicable to small space FIG. 9D dressing room. i.e. 1.83 m/1.83 m and is combined with modules (ECO+2 UCO+TAP+ROD) a, b and FIG. 10. This module is for small rectangular FIG. 10C dressing room 1.83/1.22 m and is combined with modules (ECO+UCO+TAP) a and b, FIGS. 10A and 10B.

Characteristics of the Modular System Package

The package features a picture of the installed and assembled product in an adequate space and presenting several items corresponding to a house wardrobe. In said picture, the high design efficiency of the modular system is shown taking advantage of the width and height of the available space.

On the package, an exploded view of the pieces forming it is shown to communicate to the user the contents of the box (the drawing omits the assembling and installation fittings that are only mentioned with letters)

The package shows the recommended width parameters, the advantages of the product, some combinations with other products and the options of the adjustment to the width of several existing enclosures. The architectonic design offers design solutions for the most varied closet enclosures with the most efficient storage, exhibition and transportation method.

The arrangement of the pieces inside the packing box permits that the contents support the compression and the load of the boxes placed above avoiding the crushing of the packages.

The size of the boxes permits to stow them on standard 40"×48" pallets which are placed according to well established patterns for warehouse storage standard structures, within marine containers, piggy backs, trailer and other long distance transportation means. There are hydraulic skates, weight lifters and other devices to move them easily.

The boxes can be placed and transported vertically on said standard pallets to be taken to the market centers so that the user can easily handle a compact packing box in his or her own vehicle.

On the packing boxes there are instruction leaflets which are understandable without the need to read the texts. In such a way it is not important if the installer can read or not or whether he understands one of the three languages in which the texts are written or not.

The boxes and the labels are printed in colors which are characteristic of each model and the short and clear keys on the products are shown in a large size on all the sides of the boxes, so that they are easily identifiable and can be seen even if they are high up on metal storage structures, for example.

The advantages of the described invention have been presented in an economical and practical manner. Although specific embodiments and example configurations have been described, it is to be understood that various modifications and additional configurations will be apparent to the skilled in the art. It is intended that the specific embodiments and configurations herein are illustrative of the preferred and best modes for practicing the invention, and should not be interpreted as limitations on the scope of the invention as defined by appended claims.

The invention claimed is:

1. A modular system of combinable and adjustable design for inside closet use or as dressing room complements of different widths, the system comprising:

a) a first tower module directly mounted on a side wall; said first tower having one or more vertical screens of the same length and a plurality of shelves placed on either in the upper part or along the tower according to different module types or combination thereof; wherein the rear end of the vertical screens do not touch the back wall;

b) at least one or more hanging element module of variable length on one side or on the other side of the tower; said hanging element extending sidewardly from the tower module to engage an adjacent wall or another tower;

c) optionally, comprising a second tower module having one or more vertical screens of the same length and plurality of shelves placed either in upper part or along the tower; said vertical screen adjoining to one side or other side of the adjacent wall of one or more hanging element of variable length.

2. The modular system according to claim 1 wherein the module comprises a first tower module and one or more hanging element of variable length.

3. The modular system according to claim 1 wherein one or more hanging element of variable length is either on one side or other side of the first tower module.

4. The modular system according to claim 1 wherein one or more hanging element of variable length is on one side and other side of the first tower module.

5. The modular system according to claim 4 wherein the module further comprises a second tower module directly mounted on a side wall; said second tower having one or more vertical screens of the same length and plurality of shelves placed either in upper part or along the tower; said vertical screen adjoining to one side or other side of the adjacent wall of at least one or more hanging element of variable length.

6. The modular system according to claim 4 wherein the hanging element on one side of the tower is wider than the hanging element on the other side of the tower.

7. The modular system according to claim 5 wherein the hanging element on one side of the tower is wider than the hanging element on the other side of the tower.

8. The modular system according to claim 1 wherein at least one or more hanging element of variable length extends sidewardly on one side of the vertical screen of the first tower module and on the other side of the wall of the vertical screen of the second tower module.

9. The modular system according to claim 1 wherein the system comprises example widths corresponding to an enclosure space selected from the group consisting of 1.83 m, 1.43 m, 1.22 m, 2.44 m and 3.05 m.

10. The modular system according to claim 1 wherein the hanging element and the first tower module comprise a width corresponding to an example enclosure space of 1.83 m width.

11. The modular system according to claim 1 wherein the first tower module and hanging element are integrated by a vertical screen on one side comprising two shelves and a long clothes hanging pipe, while the other side comprises a larger space for single clothes hanging element of the same space or larger or a double hanging element depending on the width of the enclosure.

12. The modular system according to claim 1 wherein the first tower and hanging element are integrated by a couple of vertical screens and shelves arranged along the first tower module which are coupled on one side and coupled on the other side with two banging elements larger than the first tower.

13. The modular system according to claim 1 wherein the system is integrated by a vertical screen forming a first tower of a plurality of shelves arranged along the tower; said tower having its one side fastened onto a hanging element module of a single pipe for long clothes hanging or double hanging forming an example enclosure width selected from the group consisting of 1.83 m, 1.43 and 1.22 m.

14. The modular system according to claim 1 wherein the system further comprises a double hanging space of larger size with regard to its lateral sides based on two vertical screens on the center of enclosure, one side of which is a first tower having two upper shelves and a long clothes hanging element, while the other side comprises a second tower with a plurality of shelves distributed along the tower and forming a single module for a 2.44 m example enclosure space.

15. The modular system according to claim 1 wherein the first and second tower module further comprises additional shelves for shoes or towels.

16. The modular system according to claim 1, wherein one side of the first tower module or second tower module comprises three distributed shelves in its middle to upper part and various shelves in its lower part.

17. The modular system according to claim 1 wherein the closet has an example width of 3.05 m, the first tower being located at the center which is formed by two screens having the same size and a plurality of shelves distributed along the screens, being coupled on its one side to a double hanging element module and on the other side is a single hanging element module, said module laterally wider than the first tower.

18. The modular system according to claim 1 wherein said module further comprises a first tower having two shelves with three vertical screens having the same length; two double hanging modules wherein one side is wider than the other side, the narrowest located on the right hand side and the other side between the long clothes hanging module and the tower integrated by three equidistantly placed shelves from the middle part to the upper part of the first tower; wherein the tower further comprises additional shelves in its lower part.

19. The modular system according to claim 1 wherein the module is assembled in an "L" shape arrangement.

20. The modular system according to claim 1 wherein a "U" shaped enclosure wall is assembled on the sides of first tower, second tower and hanging element module.

* * * * *